US008209106B2

(12) United States Patent
Ohtsuka et al.

(10) Patent No.: US 8,209,106 B2
(45) Date of Patent: Jun. 26, 2012

(54) CONTROL APPARATUS FOR INTERNAL COMBUSTION ENGINE

(75) Inventors: Kaoru Ohtsuka, Mishima (JP); Shinichi Soejima, Gotenba (JP); Naoto Kato, Susono (JP); Hiroyuki Tanaka, Susono (JP); Hayato Nakada, Susono (JP); Keisuke Kawai, Odawara (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 380 days.

(21) Appl. No.: 12/669,897

(22) PCT Filed: Jul. 11, 2008

(86) PCT No.: PCT/JP2008/062557

§ 371 (c)(1),
(2), (4) Date: Jan. 20, 2010

(87) PCT Pub. No.: WO2009/025133

PCT Pub. Date: Feb. 26, 2009

(65) Prior Publication Data

US 2010/0198485 A1 Aug. 5, 2010

(30) Foreign Application Priority Data

Aug. 21, 2007 (JP) ..... 2007-215036

(51) Int. Cl.
*F02P 5/15* (2006.01)

(52) U.S. Cl. ..... 701/103; 701/104; 123/406.23; 123/672

(58) Field of Classification Search ..... 701/103, 701/104; 123/406.23, 672
See application file for complete search history.

(56) References Cited

U.S. PATENT DOCUMENTS

| | | | | |
|---|---|---|---|---|
| 6,278,933 | B1 * | 8/2001 | Buckland et al. | 701/104 |
| 7,086,382 | B2 * | 8/2006 | Daniels et al. | 123/406.23 |
| 7,748,362 | B2 * | 7/2010 | Whitney et al. | 123/406.23 |
| 7,980,221 | B2 * | 7/2011 | Baur et al. | 123/435 |
| 2005/0109318 | A1 | 5/2005 | Ichihara et al. | |

FOREIGN PATENT DOCUMENTS

| | | |
|---|---|---|
| JP | A-2002-303177 | 10/2002 |
| JP | A-2003-301766 | 10/2003 |
| JP | A-2004-140677 | 5/2004 |
| JP | A-2005-171979 | 6/2005 |
| JP | A-2006-188205 | 7/2006 |
| JP | A-2007-113527 | 5/2007 |

OTHER PUBLICATIONS

International Search Report issued in International Application No. PCT/JP2008/062557; Mailed Sep. 2, 2008.

* cited by examiner

*Primary Examiner* — Erick Solis
(74) *Attorney, Agent, or Firm* — Oliff & Berridge, PLC

(57) ABSTRACT

A control apparatus for an internal combustion engine that accurately incorporates demands related to various capabilities of the internal combustion engine. A demand output unit outputs various capability demands of the internal combustion engine, expressed in terms of either torque, efficiency, or an air-fuel ratio data. A torque mediation unit collects only the demand values expressed in terms of torque, and mediates the torque demand values into one. An efficiency mediation unit collects the demand values expressed in terms of efficiency and mediates the efficiency demand values into one. An air-fuel ratio mediation unit collects the demand values expressed in terms of the air-fuel ratio and mediates the air-fuel ratio demand values into one. A control variable computing unit computes control variables of actuators, based upon the torque demand value, efficiency demand value, and air-fuel ratio demand value output from the mediation units.

9 Claims, 6 Drawing Sheets

CONTROL APPARATUS FOR INTERNAL COMBUSTION ENGINE

TECHNICAL FIELD

The present invention relates generally to control apparatuses for internal combustion engines. More particularly, the invention concerns a control apparatus that achieves demands related to various capabilities of an internal combustion engine, by coordinative control of a plurality of actuators.

BACKGROUND ART

Known techniques related to control of a torque in an internal combustion engine include the one disclosed, for example, in JP-A-2003-301766. In the technique disclosed therein, an indicated torque demand from a driver is calculated using an accelerator pedaling angle value, and a desired air-fuel ratio is determined inside a control apparatus. After this, the indicated torque demand is corrected using torque efficiency with respect to ignition timing and torque efficiency with respect to the desired air-fuel ratio, and a desired throttle angle is further determined from the desired amount of air calculated from the corrected torque. In addition, an air intake delay correction value is calculated from the desired amount of air and the engine speed, then an ignition timing retard angle is calculated from the above-corrected torque and the estimated torque determined by the air intake delay correction value, and final ignition timing is determined from the ignition timing retard angle and the basic ignition timing determined by an intake air amount. Furthermore, a desired fuel injection amount is determined from the intake air amount and the desired air-fuel ratio.

Briefly, the conventional technique disclosed in the above patent application can be described as one in which the throttle angle, the ignition timing, and the fuel injection amount are coordinatively controlled so as to achieve both the indicated torque demand value demanded from the driver, and the desired air-fuel ratio demanded from the inside of the control apparatus.

DISCLOSURE OF THE INVENTION

Problems to be Solved by the Invention

In the technique of the above patent application, the indicated torque demand value can be regarded as a demand related to drivability, and the desired air-fuel ratio, as a demand related to exhaust gases. Drivability and exhaust gas emission are both among the capabilities of the internal combustion engine, and in addition to the two capabilities, there exist various other capabilities of the internal combustion engine, including those related to fuel economy and knocking. There are demands for each such capability. For example, demands for enhanced combustion efficiency and for reduced pump loss exist for the capabilities related to fuel economy. Also, demands for a higher exhaust gas temperature and for accelerated reactions in a catalyst exist for the capabilities related to exhaust gases.

Internal combustion engines have various capabilities as described above, and a variety of demands that are each different in level exist for each of the capabilities. The conventional technique described in the above patent application, however, achieves no more than a part of the demands and does not implement all of the diverse demands of the internal combustion engine. In addition, the above conventional technique does not employ a control structure that permits additional demands to be easily incorporated into actuator operation.

The present invention has been made with a view to solving the foregoing problems, and an object of the invention is to provide a control apparatus for an internal combustion engine, the control apparatus being adapted such that demands related to various capabilities of the internal combustion engine can be properly realized by incorporating the demands into operation of actuators in an appropriate manner.

Means to Solve the Problem

In order to attain the object described above, a first aspect of the present invention is a control apparatus for an internal combustion engine, comprising:

a plurality of actuators related to operation of the internal combustion engine;

a demand output unit that outputs demands related to various capabilities of the internal combustion engine, each of the demands being expressed in physical quantities of either torque, efficiency, or an air-fuel ratio;

a torque mediation unit that collects, of a plurality of demand values output from the demand output unit, only demand values expressed in terms of torque, and then mediates the torque demand values into one in accordance with a predetermined rule;

an efficiency mediation unit that collects, of the plurality of demand values, only demand values expressed in terms of efficiency, and then mediates the efficiency demand values into one in accordance with a predetermined rule;

an air-fuel ratio mediation unit that collects, of the plurality of demand values, only demand values expressed in terms of an air-fuel ratio, and then mediates the air-fuel ratio demand values into one in accordance with a predetermined rule; and a control variable computing unit that computes control variables of each actuator, based upon the torque demand value, efficiency demand value, and air-fuel ratio demand value output from the respective mediation units.

A second aspect of the present invention is the control apparatus for the internal combustion engine according to the first aspect of the present invention, wherein the various capabilities include capabilities related to drivability, capabilities related to exhaust gases, and capabilities related to fuel consumption.

A third aspect of the present invention is the control apparatus for the internal combustion engine according to the first or second aspect of the present invention, wherein the plurality of actuators include an actuator that adjusts an intake air amount in the internal combustion engine, an actuator that adjusts ignition timing in the internal combustion engine, and an actuator that adjusts a fuel injection amount in the internal combustion engine.

A fourth aspect of the present invention is the control apparatus for the internal combustion engine according to any one of the first to the third aspects of the present invention, the control apparatus further comprising:

a modification unit that modifies at least one of the torque demand value, efficiency demand value, and air-fuel ratio demand value output from the respective mediation units, and thereby ensures that the torque demand value, the efficiency demand value, and the air-fuel ratio demand value have a relationship suitable for appropriate operation of the internal combustion engine.

A fifth aspect of the present invention is the control apparatus for the internal combustion engine according to the fourth aspect of the present invention, wherein the modification unit modifies only either the efficiency demand value or the air-fuel ratio demand value without modifying the torque demand value.

A sixth aspect of the present invention is the control apparatus for the internal combustion engine according to any one of the first to the fifth aspects of the present invention, wherein the control variable computing unit includes a storage portion in which are stored respective standard values of the efficiency demand value and the air-fuel ratio demand value; and the control variable computing unit is constructed such that if the efficiency demand value is not output from the efficiency mediation unit or if the air-fuel ratio demand value is not output from the air-fuel ratio mediation unit, the computing unit uses the stored standard values to compute the control variables of each actuator.

A seventh aspect of the present invention is the control apparatus for the internal combustion engine according to any one of the first to the sixth aspects of the present invention, wherein the efficiency mediation unit includes a storage portion in which standard values are stored for items corresponding to the demand values that are to be output from the demand output unit to the efficiency mediation unit; and the efficiency mediation unit is constructed such that for an item corresponding to a demand value not to be output from the demand output unit to the efficiency mediation unit, the mediation unit uses the stored appropriate standard value to adjust the efficiency demand value.

An eighth aspect of the present invention is the control apparatus for the internal combustion engine according to any one of the first to the seventh aspects of the present invention, wherein the air-fuel ratio mediation unit includes a storage portion in which standard values are stored for items corresponding to the demand values that are to be output from the demand output unit to the air-fuel ratio mediation unit; and the air-fuel ratio mediation unit is constructed such that for an item corresponding to a demand value not to be output from the demand output unit, the air-fuel ratio mediation unit uses the stored appropriate standard value to adjust the air-fuel ratio demand value.

A ninth aspect of the present invention is the control apparatus for the internal combustion engine according to any one of the sixth to the eighth aspects of the present invention, wherein, of the demands related to the various capabilities, items expressed in terms of efficiency and items expressed in terms of the air-fuel ratio are each assigned a predetermined standard demand; and the demand output unit is constructed such that for items expressed in terms of efficiency or the air-fuel ratio, the output unit will output demand values only if demands different from respective standard demands exist.

Effects of the Invention

Outputs from the internal combustion engine include heat and exhaust gases in addition to torque, and the entirety of these outputs determines the various capabilities of the internal combustion engine. According to the first aspect of the present invention, demands related to the various capabilities of the internal combustion engine are each expressed in physical quantities of either torque, efficiency, or an air-fuel ratio. Torque, efficiency, and the air-fuel ratio are three major factors that determine the outputs of the internal combustion engine. Therefore, using these physical quantities to represent the demands related to the various capabilities, and compute actuator control variables based upon the torque demand value, efficiency demand value, and air-fuel ratio demand value obtained by mediating the above demands, allows the appropriate control of actuator operation so that the demands are incorporated into the outputs of the internal combustion engine.

According to the second aspect of the invention, the demands related to the drivability, exhaust gases, and fuel consumption that are capability items of the internal combustion engine, can be easily achieved. The demands related to drivability can be expressed in terms of torque or efficiency, for example. The demands related to exhaust gases can be expressed in terms of efficiency or the air-fuel ratio, for example. The demands related to fuel consumption can also be expressed in terms of efficiency or the air-fuel ratio, for example.

According to the third aspect of the invention, the demands related to each capability of the internal combustion engine can be easily achieved by controlling the intake air amount, the ignition timing, and the fuel injection amount. The intake air amount can be computed from the torque demand value and the efficiency demand value. The ignition timing can be computed from the torque demand value. The fuel injection amount can be computed from the air-fuel ratio demand value. The three demand values, however, only form a part of the information used to calculate the control variables, so information on operating parameters and operational states of the internal combustion engine, such as an estimated torque value or the engine speed, can be used instead of the above three demand values or combined therewith.

According to the fourth aspect of the invention, at least one of the three demand values, namely, the torque demand value, the efficiency demand value, and the air-fuel ratio demand value, is modified to have a relationship that allows the appropriate operation of the internal combustion engine, and control variables based upon the modified demand value are assigned to each actuator. The actuators can therefore be coordinated with one another to prevent a serious operational failure from occurring in the internal combustion engine, even if whatever demand is output from the demand output section.

According to the fifth aspect of the invention, if the efficiency demand value or the air-fuel ratio demand value is appropriately modified without the torque demand value being modified, accurate torque control can be executed and at the same time, other demands related to efficiency and the air-fuel ratio can also be achieved as far as possible.

According to the sixth aspect of the invention, if the demand values other than the torque demand value that is mandatory in the control of the internal combustion engine, that is, the efficiency demand value and the air-fuel ratio demand value are not output from the efficiency mediating section, these demand values will be replaced by respective standard values during the computation of the actuator control variables. Even in such a case, therefore, each actuator can be appropriately operated so that engine trouble does not occur during the operation of the internal combustion engine.

According to the seventh aspect of the invention, if the demand values related to any specific items on efficiency are not output from the demand output section, those demand values will be replaced by respective standard values during the mediation of the efficiency demand values. Even in such a case, therefore, each actuator can be appropriately operated so that engine trouble does not occur during the operation of the internal combustion engine.

According to the eighth aspect of the invention, if the demand values related to any specific items on the air-fuel ratio are not output from the demand output section, those demand values will be replaced by respective standard values during the mediation of the air-fuel ratio demand values. Even in such a case, therefore, each actuator can be appropriately operated so that engine trouble does not occur during the operation of the internal combustion engine.

According to the ninth aspect of the invention, for items other than the torque item that is mandatory in the control of the internal combustion engine, that is, for the items expressed in terms of efficiency or the air-fuel ratio, demand values are output, only if any demands different from standard ones exist. Thus, arithmetic loads on the control apparatus can be reduced by, under the standard demands, conducting computations using the standard values.

DESCRIPTION OF NOTATIONS

Figure 1:
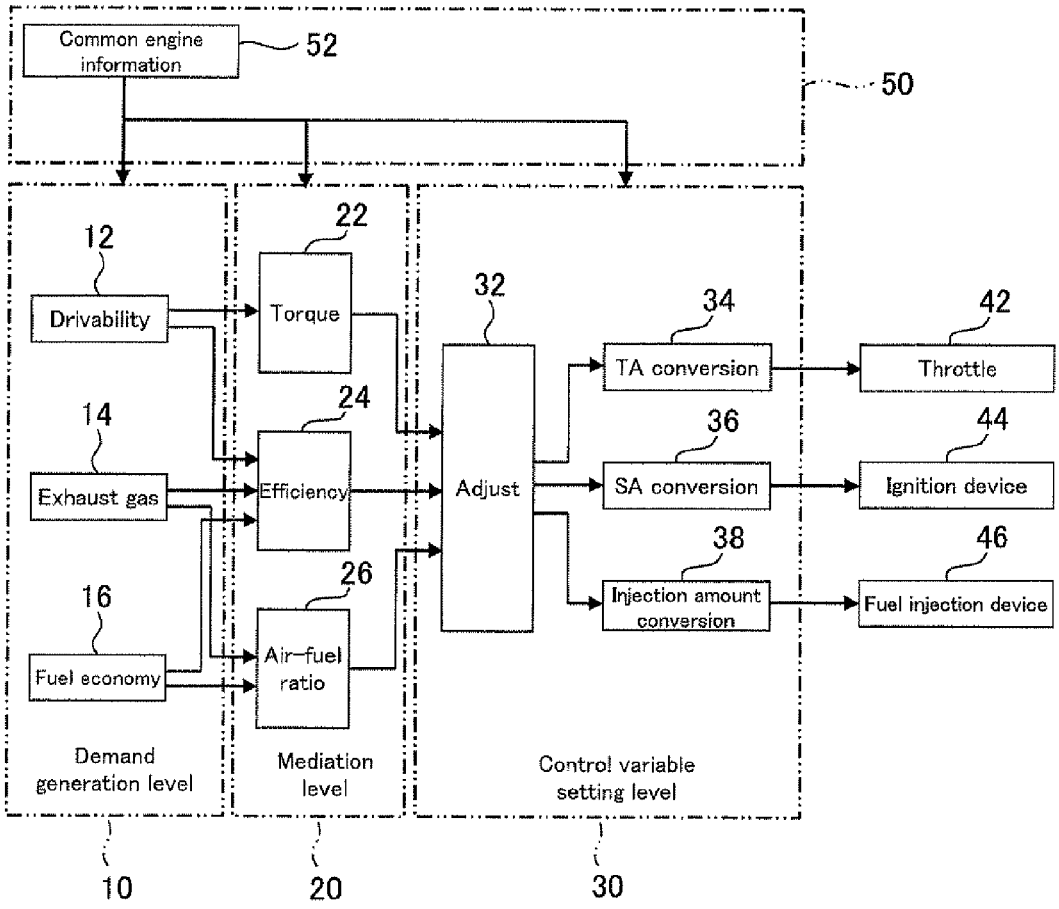
FIG. 1 is a block diagram illustrating the configuration of an engine control apparatus according to a first embodiment of the present invention.

10 demand generation level
12, 14, 16, 72 demand output element
20 mediation level
22 torque mediation element
24 efficiency mediation element
26 air-fuel ratio mediation element
32 adjuster portion
34, 36, 38, 74 control variable calculation element
42, 44, 46, 76 actuator
50 common signal delivery system
52 information source
202 superposition element
204, 212, 216, 220 minimum value selection element
214, 218 maximum value selection element
302, 314, 316 guard
304 map for selecting upper/lower limit values of efficiency
308, 322 selector part
312 torque efficiency calculator part (divider part)
320 map for selecting upper/lower limit values of air-fuel ratio

BEST MODES FOR CARRYING OUT THE INVENTION

First Embodiment

A first embodiment of the present invention will be described below with reference to drawings. The first embodiment of the present invention will be described, in which the control apparatus of the present invention is applied to a spark ignition type internal combustion engine (hereinafter referred to as the "engine"). The present invention is nonetheless applicable to any type of engine other than the spark ignition type, for example, a diesel engine.

An engine control apparatus in the first embodiment of the present invention is structured as shown by a block diagram of FIG. 1. FIG. 1 shows various elements of the control apparatus in blocks and transmission of signals between the blocks by arrows. Arrangements and characteristics of the control apparatus according to the embodiment will be described below with reference to FIG. 1. To enable an even deeper understanding of the characteristics of this embodiment, detailed drawings may be used as necessary for the description of the embodiment.

Referring to FIG. 1, the control apparatus has a control structure of a hierarchical type including three levels of hierarchy 10, 20, and 30. The control structure includes, in sequence from a highest level to a lowest level of hierarchical levels, a demand generation level 10, a mediation level 20, and a control variable setting level 30. Actuators of various types 42, 44, and 46 are connected to the control variable setting level 30 on the lowest level of hierarchy. A signal flows in one direction only between the levels 10, 20, and 30 of the control apparatus, and the signal is transmitted from the demand generation level 10 to the mediation level 20 and from the mediation level 20 to the control variable setting level 30. The control apparatus further includes a common signal delivery system 50 that is disposed independently of these levels 10, 20, and 30 and delivers a common signal parallel to each of the levels 10, 20, and 30.

Signals transmitted between the levels 10, 20, and 30 differ from those delivered from the common signal delivery system 50 as follows. Specifically, the signals transmitted between the levels 10, 20, and 30 are converted from demands related to capabilities of the engine and eventually translated to corresponding control variables for the actuators 42, 44, and 46. In contrast, the signals delivered from the common signal delivery system 50 include information required when the demands are generated or the control variables are calculated: specifically, information on operating conditions and operating states of the engine (for example, engine speed, amount of intake air, estimated torque, current actual ignition timing, coolant temperature, valve timing, and operating mode). Sources of these types of information 52 include sensors of various types disposed on the engine and an internal estimation capability of the control apparatus. The information of these types is common engine information shared among the levels 10, 20, and 30. Accordingly, delivering the information parallel to each of the levels 10, 20, and 30 will not only help reduce a volume of communications among the levels 10, 20, and 30, but also retain simultaneity of information among the levels 10, 20, and 30.

Arrangements of each of the levels 10, 20, and 30 and processing performed therein will be described in detail below in descending order of hierarchical levels.

The demand generation level 10, which corresponds to the demand output unit of the present invention, includes a plurality of demand output elements 12, 14, and 16 disposed therein. "Demand" as the term is herein used means that which is related to a capability of the engine. Each of the demand output elements 12, 14, and 16 is dedicated to a corresponding capability of the engine. Engine capabilities include drivability, exhaust gas, fuel economy, noise, and vibration, to name a few. These may be said to be performance required for the engine. Different demand output elements need to be disposed in the demand generation level 10 depending on what is demanded from the engine and what should be given top priority. In this embodiment, the demand output element 12 is provided to correspond to the capability related to the drivability, the demand output element 14 is provided to correspond to the capability related to the exhaust gas, and the demand output element 16 is provided to correspond to the capability related to the fuel economy.

The demand output elements 12, 14, and 16 output numerical values that represent the demands related to the engine capabilities. The control variable of the actuators 42, 44, and 46 are determined through arithmetic operations, so that the demands are quantified to allow the demands to be reflected in the control variables of the actuators 42, 44, and 46. In this embodiment, the following three types of physical quantities are used in expressing the demands: torque, efficiency, and air-fuel ratio.

Outputs from the engine include heat and exhaust gases in addition to torque, and the entirety of these outputs determines the various capabilities of the engine, including the above-described items related to drivability, exhaust gas emission, and fuel economy. Parameters for controlling the outputs can be collected into the three kinds of physical quantities related to torque, efficiency, and the air-fuel ratio. It is considered, therefore, that demands can be reliably incorporated into the engine outputs by representing the demands in terms of the three kinds of physical quantities related to torque, efficiency, and the air-fuel ratio, and conducting operational control of the actuators 42, 44, and 46.

In FIG. 1, though only typically, the demand output element 12 outputs the demand related to drivability using a demand value expressed in torque or efficiency. For example, if the demand is acceleration of a vehicle, that particular demand can be expressed in torque. If the demand is to prevent engine stalling, that particular demand can be expressed in efficiency (increased efficiency).

The demand output element 14 outputs the demand related to exhaust gas using a demand value expressed in efficiency or air-fuel ratio. For example, if the demand is to warm a catalyst, that particular demand can be expressed in efficiency (decreased efficiency) or air-fuel ratio. The decreased efficiency can increase an exhaust gas temperature and the air-fuel ratio can set an ambience in which the catalyst is easy to react.

The demand output element 16 outputs the demand related to fuel economy using a demand value expressed in efficiency or air-fuel ratio. For example, if the demand is to increase combustion efficiency, that particular demand can be expressed in efficiency (increased efficiency). If the demand is to reduce pump loss, that particular demand can be expressed in air-fuel ratio (lean burn).

Note that the demand value outputted from each of the demand output elements 12, 14, and 16 is not limited to one for each physical quantity. For example, the demand output element 12 outputs not only a torque demand from a driver (torque calculated from accelerator opening), but also torque demands from devices of various types as they relate to vehicle control, such as VSC (vehicle stability control system), TRC (traction control system), ABS (antilock brake system), and transmission. The same holds true also with efficiency.

The common signal delivery system 50 delivers common engine information to the demand generation level 10. Each of the demand output elements 12, 14, and 16 refers to the common engine information to thereby determine the demand value to be outputted. This is because specific details of demands vary according to the operating conditions and operating states of the engine. If a catalyst temperature sensor (not shown) is used to measure the catalyst temperature, for example, the demand output element 14 determines necessity to warm the catalyst based on that temperature information and, according to a determination result, outputs a demand for efficiency or air-fuel ratio.

The demand output elements 12, 14, and 16 of the demand generation level 10 output a plurality of demands expressed in torque, efficiency, or air-fuel ratio as described above. All of these demands cannot, however, be achieved completely and simultaneously. This is because only one torque demand can be achieved even with a plurality of torque demands. Similarly, only one efficiency demand can be achieved against a plurality of efficiency demands and only one air-fuel ratio demand can be achieved against a plurality of air-fuel ratio demands. This necessitates a process of mediating the demands.

The mediation level 20 mediates demands (demand values) outputted from the demand generation level 10. The mediation level 20 includes mediation elements 22, 24, and 26, each being dedicated to a corresponding physical quantity as a classified category of demands. The torque mediation element 22, which corresponds to the torque mediation unit of the present invention, mediates one demand value expressed in torque with another to arrive at a single torque demand value. The efficiency mediation element 24, which corresponds to the efficiency mediation unit of the present invention, mediates one demand value expressed in efficiency with another to arrive at a single efficiency demand value. The air-fuel ratio mediation element 26, which corresponds to the air-fuel ratio mediation unit of the present invention, mediates one demand value expressed in air-fuel ratio with another to arrive at a single air-fuel ratio demand value. Each of the mediation elements 22, 24, and 26 performs mediation according to a predetermined rule. The rule as the term is herein used means a calculation rule for obtaining a single numeric value from a plurality of numeric values, such as, for example, selecting the maximum value, selecting the minimum value, averaging, or superposition. These calculation rules may be appropriately combined together. Which rule or rules should be applied is left to the design and, as long as the present invention is concerned, there are no restrictions in details of the rules.

Figure 2:
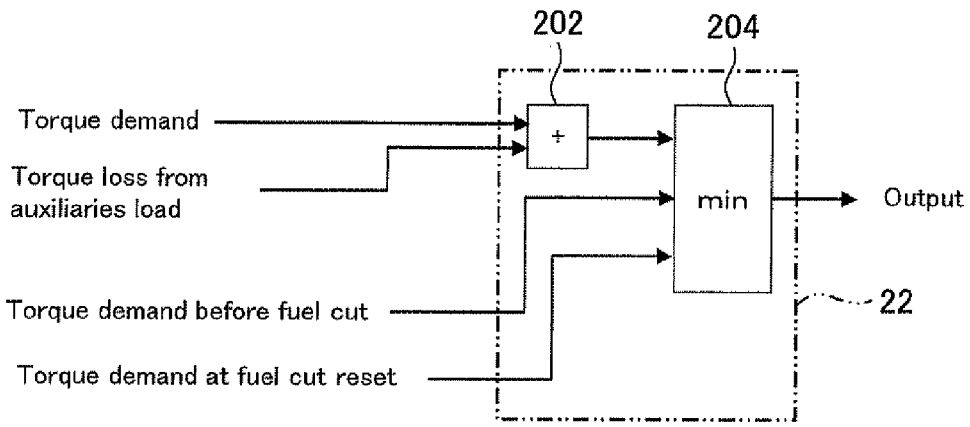
FIG. 2 is a block diagram showing typical arrangements of a mediation element (torque mediation) according to the first embodiment of the present invention.

Specific examples will be given below to enable an even deeper understanding of mediation. FIG. 2 is a block diagram showing typical arrangements of the torque mediation element 22. In this example; the torque mediation element 22 includes a superposition element 202 and a minimum value selection element 204. In addition, the demand values collected by the torque mediation element 22 in this example are a torque demand of the driver, a torque loss from auxiliaries load, a torque demand before fuel cut, and a torque demand at fuel cut reset.

Of the demand values collected by the torque mediation element 22, the torque demand of the driver and the torque loss from auxiliaries load are superposed one on top of another by the superposition element 202. An output value from the superposition element 202, together with the torque demand before fuel cut and the torque demand at fuel cut reset, is inputted to the minimum value selection element 204 and the minimum value of these is selected. The selected value is outputted from the torque mediation element 22 as a final torque demand value, specifically, a mediated torque demand value.

Figure 3:
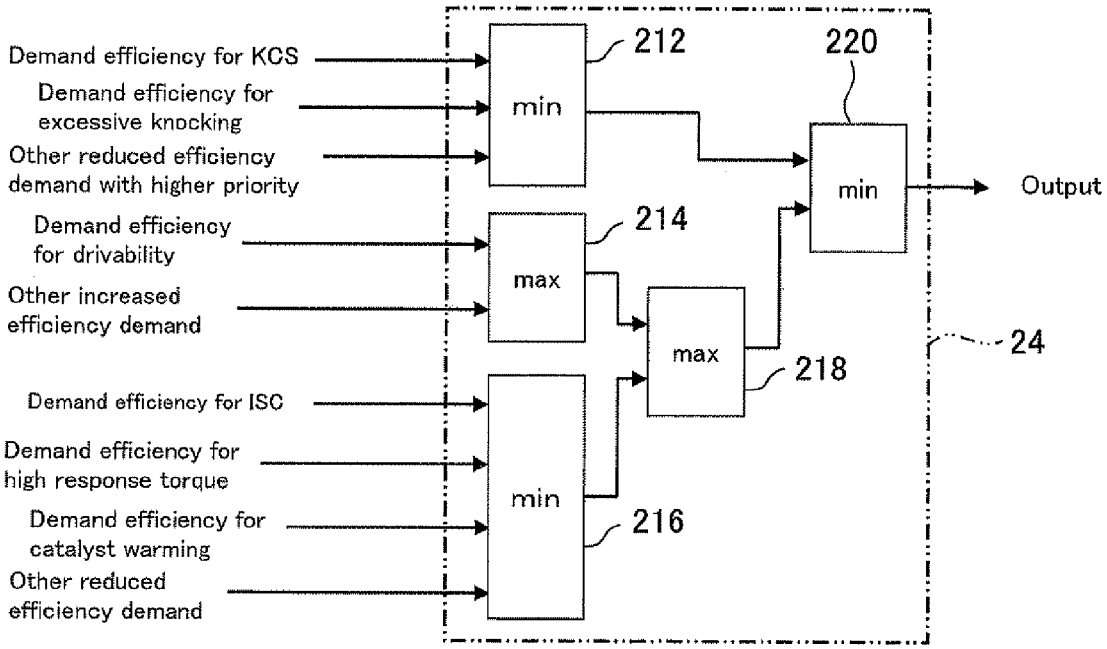
FIG. 3 is a block diagram showing typical arrangements of a mediation element (efficiency mediation) according to the first embodiment of the present invention.

FIG. 3 is a block diagram showing typical arrangements of the efficiency mediation element 24. In this example, the efficiency mediation element 24 includes three minimum value selection elements 212, 216, and 220 and two maximum value selection elements 214 and 218. In addition, the demand values collected by the efficiency mediation element 24 in this example include demand efficiency for drivability as an increased efficiency demand; demand efficiency for ISC, demand efficiency for high response torque, and demand efficiency for catalyst warming as reduced efficiency demands; and demand efficiency for KCS and demand efficiency for excessive knocking as reduced efficiency demands with higher priority.

Of the demand values collected by the efficiency mediation element 24, the drivability demand efficiency, together with other increased efficiency demands, is inputted to the maximum value selection element 214. The maximum value of these is inputted to the maximum value selection element 218. Further, the ISC demand efficiency, the high response torque demand efficiency, and the catalyst warming demand efficiency, together with other reduced efficiency demands, are inputted to the minimum value selection element 216. The minimum value of these is then inputted to the maximum value selection element 218. The maximum value selection element 218 selects the maximum value of the input value from the maximum value selection element 214 and the input value from the minimum value selection element 216 and inputs the maximum value to the minimum value selection element 220. The minimum value selection element 220 selects the minimum value of the input value from the maximum value selection element 218 and the input value from the minimum value selection element 212. The selected value is outputted from the efficiency mediation element 24 as a final efficiency demand value, specifically, a mediated efficiency demand value.

The same processing is performed also in the air-fuel ratio mediation element 26, though a specific example is herein omitted. As described earlier, specific types of elements to form the air-fuel ratio mediation element 26 are left to the design and the elements may be combined as appropriately based on the design concept of the specific designer.

As noted earlier, the common signal delivery system 50 delivers the common engine information also to the mediation level 20. Though the common engine information is not used in the above-described specific examples related to the mediation elements 22, 24, the common engine information can be used in each of the mediation elements 22, 24, and 26. For example, rules for mediation can be altered according to the operating conditions and operating states of the engine. The rules are not, however, altered in consideration of a range to be achieved by the engine as described below.

As evident from the above-described specific examples, the torque mediation element 22 does not add an upper limit torque or a lower limit torque to be actually achieved by the engine to mediation. Results of mediation by other mediation elements 24 and 26 are not added to the mediation, either. This also holds true with the mediation elements 24 and 26 which perform mediation without adding the upper and lower limits of the range to be achieved by the engine or the results of mediation of other mediation elements. The upper and lower limits of the range to be achieved by the engine vary depending on the operating conditions of the engine and a relationship among torque, efficiency, and air-fuel ratio. Accordingly, an attempt to mediate each demand value with the range to be achieved by the engine invites an increase in the operational load on the computer. Each of the mediation elements 22, 24, and 26 therefore performs mediation by collecting only the demands outputted from the demand generation level 10.

Through the foregoing mediation performed by each of the mediation elements 22, 24, and 26, one torque demand value, one efficiency demand value, and one air-fuel ratio demand value are outputted from the mediation level 20. In the control variable setting level 30 as the next hierarchical level, the control variable of each of the actuators 42, 44, and 46 is set based on these mediated torque demand value, efficiency demand value, and air-fuel ratio demand value.

The control variable setting level 30, which corresponds to the control variable computing unit of the present invention, includes one adjuster portion 32, which corresponds to the modification unit of the present invention, and a plurality of control variable calculation elements 34, 36, and 38. The control variable calculation elements 34, 36, and 38 are provided to correspond, respectively, to the actuators 42, 44, and 46. In this embodiment, the actuator 42 is a throttle, the actuator 44 is an ignition device, and the actuator 46 is a fuel injection system. Accordingly, a throttle opening is calculated as the control variable in the control variable calculation element 34 connected to the actuator 42; ignition timing is calculated as the control variable in the control variable calculation element 36 connected to the actuator 44; and a fuel injection amount is calculated as the control variable in the control variable calculation element 38 connected to the actuator 46.

Numeric values used for calculation of the control variables by each of the control variable calculation elements 34, 36, and 38 are supplied from the adjuster portion 32. The torque demand value, the efficiency demand value, and the air-fuel ratio demand value mediated by the mediation level 20 are first subjected to an adjustment in magnitude by the adjuster portion 32. This is because the range to be achieved by the engine is not added to the mediation by the mediation level 20 as described earlier, so that the engine may not be operated properly depending on the magnitude of each demand value.

The adjuster portion 32 adjusts each of the demand values based on a mutual relationship therebetween so that proper operation of the engine can be performed. At levels of hierarchy higher than the control variable setting level 30, each of the torque demand value, the efficiency demand value, and the air-fuel ratio demand value is independently calculated and resultant calculated values are not used or referred to among different elements involved in the calculation. Specifically, the torque demand value, the efficiency demand value, and the air-fuel ratio demand value are mutually referred to for the first time at the adjuster portion 32. If an attempt is made to adjust the magnitude of the demand values at a higher level of hierarchy, the number of subjects of adjustment is large, resulting in heavy operational load. When the adjustment is made at the control variable setting level 30, however, the number of subjects of adjustment is limited to three; specifically, the torque demand value, the efficiency demand value, and the air-fuel ratio demand value, requiring only a small operational load for adjustments.

How the adjustments are made is left to the design and, as long as the present invention is concerned, there are no restrictions in details of the adjustments. If a priority order is involved among the torque demand value, the efficiency demand value, and the air-fuel ratio demand value, however, the demand value with a lower priority should preferably be adjusted (modified). Specifically, the demand value with a high priority is directly reflected in the control variables of the actuators 42, 44, and 46 and the demand value with a low priority is first adjusted and then reflected in the control variables of the actuators 42, 44, and 46. This allows the demand with a high priority to be reliably realized and the demand with a low priority to be realized as much as feasible within a range of enabling proper operations of the engine. For example, if the torque demand value has the highest priority, the efficiency demand value and the air-fuel ratio demand value are corrected with the one having the lower priority of the two being corrected largely. If the priority order changes depending on, for example, the operating conditions of the engine, the priority order is determined based on the common engine information delivered from the common signal delivery system 50, thereby determining which demand value should be corrected.

Figure 4:
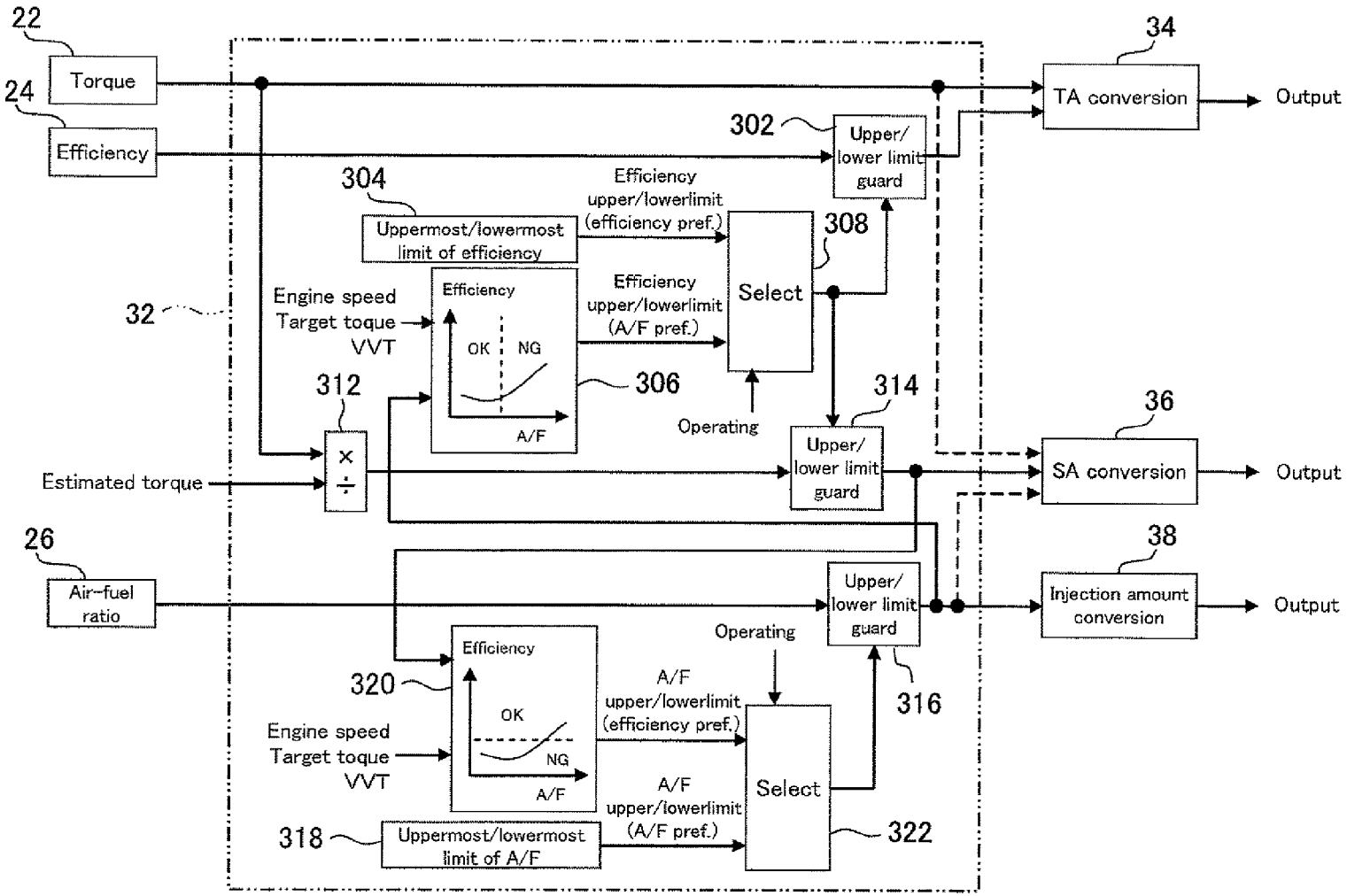
FIG. 4 is a block diagram showing typical arrangements of a adjuster portion according to the first embodiment of the present invention.

Specific examples will be given below to enable an even deeper understanding of the adjuster portion 32, FIG. 4 is a block diagram showing typical arrangements of the adjuster portion 32. In this example, an engine operating mode includes an efficiency preferential mode and an air-fuel ratio preferential mode. Arrangements will be described below that allow the abovementioned priority order to be changed according to the operating mode. The operating mode is included in the common engine information and delivered to the adjuster portion 32 via the common signal delivery system 50.

In the arrangements shown in FIG. 4, the adjuster portion 32 includes a guard 302 limiting upper and lower limits of the efficiency demand value. The guard 302 corrects the efficiency demand value mediated by the efficiency mediation element 24 such that the efficiency demand value falls within the range of enabling proper operations of the engine. The adjuster portion 32 also includes a guard 316 limiting upper and lower limits of the air-fuel ratio demand value. The guard 316 corrects the air-fuel ratio demand value mediated by the air-fuel ratio mediation element 26 such that the air-fuel ratio demand value falls within the range of enabling proper operations of the engine. The upper and lower limit values of each of the guards 302, 316 are variable so as to be variable in a manner mutually operatively associated with each other. Following describe how it works.

Available for the efficiency upper/lower limit values of the guard 302 are the upper/lower limit values (for the efficiency preferential mode) when the efficiency preferential mode is selected as the operating mode and the upper/lower limit values (for the air-fuel ratio preferential mode) when the air-fuel ratio preferential mode is selected as the operating mode. Changing a limiting range of the guard 302 allows the magnitude of the efficiency demand value to be adjusted. A selector part 308 selects either type of the efficiency upper/lower limit values according to the operating mode and sets the selected efficiency upper/lower limit values in the guard 302.

The efficiency upper/lower limit values for the efficiency preferential mode represent uppermost/lowermost limit values throughout an entire air-fuel ratio range and values stored in a memory 304 are read. The efficiency upper/lower limit values for the air-fuel ratio preferential mode, on the other hand, represent the upper/lower limit values of the efficiency with which knocking and misfire can be avoided at the preferential air-fuel ratio. These values are read from a map 306 based on the operating conditions including an engine speed, a target torque, and valve timing. The air-fuel ratio demand value processed by the guard 316 is inputted to the map 306 and, with reference to this air-fuel ratio demand value, the efficiency upper/lower limit values are determined.

Available for the air-fuel ratio upper/lower limit values of the guard 316 are the upper/lower limit values (for the efficiency preferential mode) when the efficiency preferential mode is selected as the operating mode and the upper/lower limit values (for the air-fuel ratio preferential mode) when the air-fuel ratio preferential mode is selected as the operating mode. Changing a limiting range of the guard 316 allows the magnitude of the air-fuel ratio demand value to be adjusted. A selector part 322 selects either type of the air-fuel ratio upper/lower limit values according to the operating mode and sets the selected air-fuel ratio upper/lower limit values in the guard 316.

The air-fuel ratio upper/lower limit values for the air-fuel ratio preferential mode represent uppermost/lowermost limit values throughout an entire efficiency range and values stored in a memory 318 are read. The air-fuel ratio upper/lower limit values for the efficiency preferential mode, on the other hand, represent the upper/lower limit values of the air-fuel ratio with which knocking and misfire can be avoided at the preferential efficiency. These values are read from a map 320 based on the operating conditions including the engine speed, the target torque, and the valve timing. A torque efficiency processed by a guard 314 to be described later is inputted to the map 320 and, with reference to this torque efficiency, the air-fuel ratio upper/lower limit values are determined. Definition and a calculation method of the torque efficiency will be described later.

Figure 5:
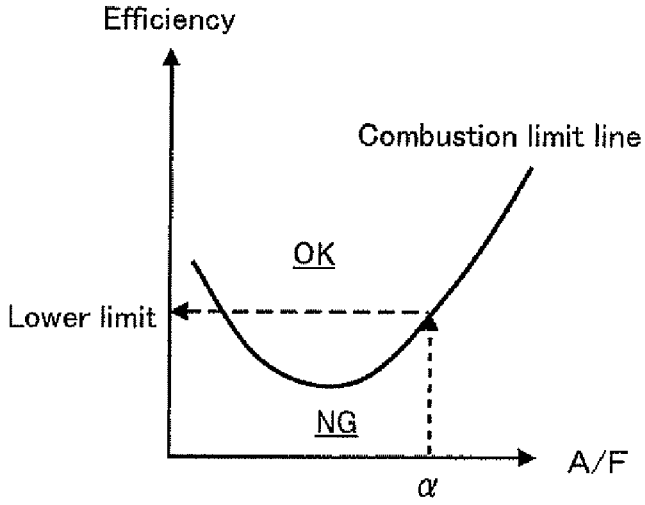
FIG. 5 is a diagram showing a setting method for the efficiency upper/lower limit values considering air-fuel ratio according to the first embodiment of the present invention.
Figure 6:
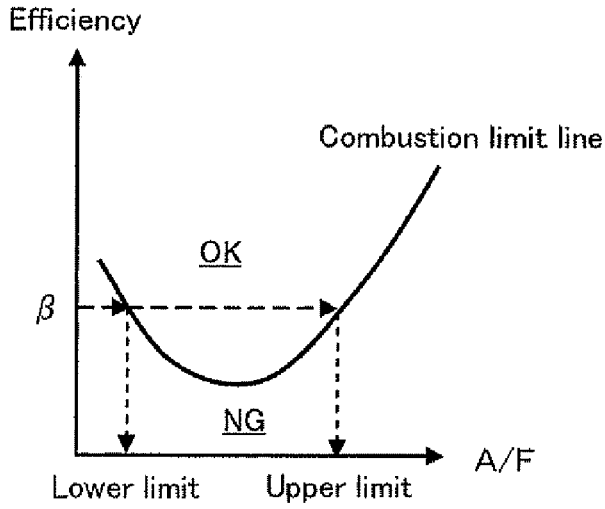
FIG. 6 is a diagram showing a setting method for the air-fuel ratio upper/lower limit values considering efficiency according to the first embodiment of the present invention.

FIG. 5 is a diagram showing a setting method for the efficiency upper/lower limit values using the map 306. FIG. 6 is a diagram showing a setting method for the air-fuel ratio upper/lower limit values using the map 320. In each figure, the ordinate represents the efficiency and the abscissa represents the air-fuel ratio. The curve shown in the figure is a combustion limit line. The area below the combustion limit line is an NG area in which proper operations cannot be performed. The combustion limit line depends on the operating conditions including the engine speed, the target torque, and the valve timing.

First, when the air-fuel ratio preferential mode is selected as the operating mode, an air-fuel ratio demand value $\alpha$ is inputted to the map as shown in FIG. 5. A value of efficiency corresponding to the air-fuel ratio demand value $\alpha$ in the combustion limit line is then calculated. That value is set as the efficiency lower limit value at the air-fuel ratio demand value a. A predetermined value (for example, 1) is used for the efficiency upper limit value. The set efficiency lower limit value and efficiency upper limit value are set in the guard 302 by the selector part 308.

If the efficiency preferential mode is selected as the operating mode, a torque efficiency $\beta$ is inputted to the map as shown in FIG. 6. A value of air-fuel ratio corresponding to the torque efficiency $\beta$ in the combustion limit line is then calculated. In the case shown in the figure, two large and small values of the air-fuel ratio corresponding to the torque efficiency $\beta$ exist, the larger value being set as the air-fuel ratio upper limit value at the torque efficiency $\beta$ and the smaller value being set as the air-fuel ratio lower limit value at the torque efficiency $\beta$. The set air-fuel ratio lower limit value and air-fuel ratio upper limit value are set in the guard 316 by the selector part 322.

Additionally, the adjuster portion 32 can generate a new signal using the demand value inputted from the mediation level 20 and the common engine information delivered from the common signal delivery system 50. In the example shown in FIG. 4, a divider part 312 calculates a ratio between the torque demand value mediated by the torque mediation element 22 and an estimated torque included in the common engine information. The estimated torque represents torque to be outputted when the ignition timing is MBT with the current amount of intake air and air-fuel ratio. The calculation of the estimated torque is performed by another task of the control apparatus.

The ratio between the torque demand value and the estimated torque calculated by the divider part 312 is called torque efficiency. The guard 314 limits the upper and lower limits of the torque efficiency. The efficiency upper/lower limit values selected by the selector part 308 are set in the guard 314. Specifically, the limiting range of this guard 314 is set in the same manner as with the guard 302 that limits the upper/lower limits of the efficiency demand value.

As a result of the foregoing processing, signals outputted from the adjuster portion 32 represent a torque demand value, a corrected efficiency demand value, a corrected air-fuel ratio demand value, and torque efficiency. Of these signals, the torque demand value and the corrected efficiency demand value are inputted to the control variable calculation element 34. The control variable calculation element 34 first divides the torque demand value by the corrected efficiency demand value. Because the corrected efficiency demand value is a value equal to, or less than 1, the torque demand value is corrected to be increased by this division. The corrected to be increased torque demand value is then translated to an amount of air, from which the throttle opening is calculated.

The torque efficiency is inputted as a main signal to the control variable calculation element 36. The torque demand value and the corrected air-fuel ratio demand value are also inputted as reference signals. The control variable calculation element 36 calculates an amount of retard angle relative to the MBT from the torque efficiency. The smaller the torque efficiency, the greater the value of the amount of retard angle. This results in reduction in torque. Inflation of the torque demand value performed by the control variable calculation element 34 is a process of compensating for torque reduction by the retard. In this embodiment, the torque demand value and the efficiency demand value can both be achieved by the retard of the ignition timing based on the torque efficiency and the inflation of the torque demand value based on the efficiency demand value. The torque demand value and the corrected air-fuel ratio demand value inputted to the control variable calculation element 36 are used for selecting the map for converting torque efficiency to the amount of retard angle. The final ignition timing is then calculated from the amount of retard angle and the MBT (or a basic ignition timing).

The corrected air-fuel ratio demand value is inputted to the control variable calculation element 38. The control variable calculation element 38 calculates the fuel injection amount from the corrected air-fuel ratio demand value and the amount of intake air into a cylinder. The amount of intake air is included in the common engine information and delivered to the control variable calculation element 38 from the common signal delivery system 50.

As described above, in the control apparatus of the present embodiment, the demands related to the drivability, exhaust gas emission, and fuel economy that are capability items of the engine are each expressed in terms of either torque, efficiency, or the air-fuel ratio. Torque, efficiency, and the air-fuel ratio are three major factors that determine the outputs of the internal combustion engine. Therefore, using these physical quantities to represent the demands related to the above capabilities and compute the control variables of the actuators 42, 44, and 46, based upon the torque demand value, efficiency demand value, and air-fuel ratio demand value obtained by mediating the above demands, allows the appropriate operational control of the actuators 42, 44, and 46 so that the demands are incorporated into the engine outputs.

Figure 7:
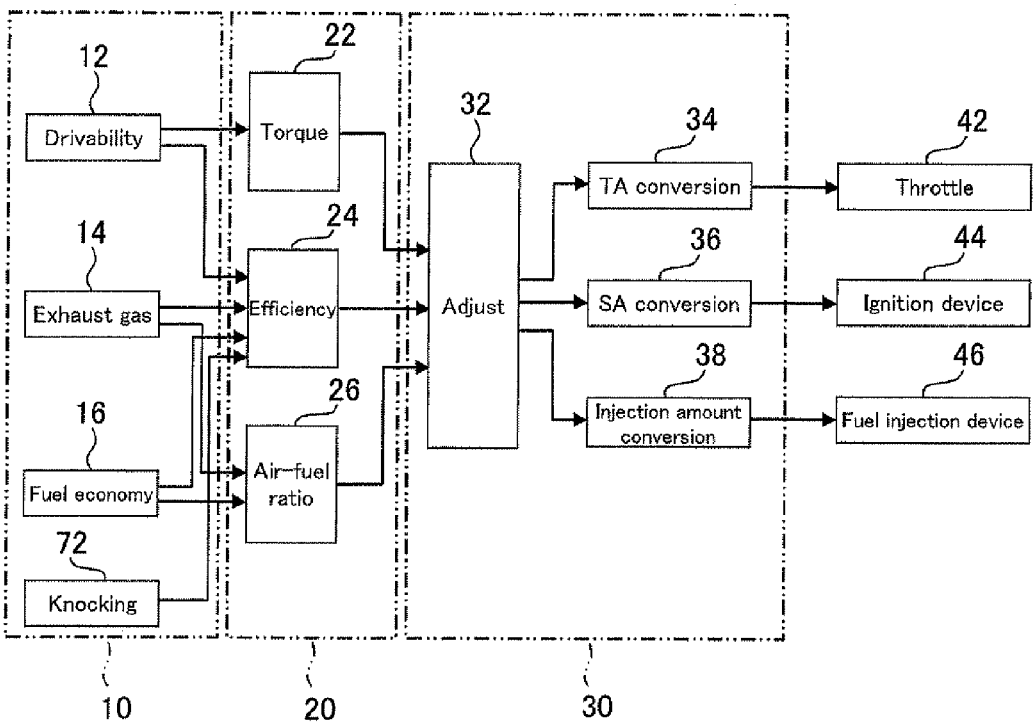
FIG. 7 is a block diagram illustrating a modification on the configuration of the engine control apparatus shown in FIG. 1.

According to the control apparatus of the present embodiment, capabilities to be implemented can be easily added. FIG. 7 is a block diagram showing a configuration in which a capability related to knocking is added as a new one. In the configuration of FIG. 7, a demand output element 72 appropriate for the new capability is additionally included in the demand generation level 10. The demands related to knocking can be expressed in terms of efficiency, one of the three major factors (torque, efficiency, and air-fuel ratio) that determine the engine outputs. The demand values output from the demand output element 72, therefore, will be input to the efficiency mediation element 24.

Signals are transmitted in one direction from the demand generation level 10 to the mediation level 20, and at the demand generation level 10, no signals are transmitted between the elements within the same hierarchical level, so the addition of the new demand output element 72 does not change other element designs. The demand values that have been output from the added demand output element 72 are collected, together with those which have been output from other demand output elements (namely, the elements 12, 14, and 16), in the efficiency mediation element 24, by which the output demand values are then mediated into one efficiency demand value.

The efficiency mediation element 24 only mediates the demand values in accordance with predetermined rules. Even if the number of demand values to be collected is increased, an associated increase in arithmetic load will be very insignificant. In addition, it will remain unchanged in that only the torque demand value, the efficiency demand value, and the air-fuel ratio demand value are output from the mediation level 20 to the control variables setting level 30, so that the control variables setting level 30 will not increase in arithmetic load. Briefly, according to the control apparatus of the present embodiment, the engine capabilities to be realized can be added without increasing the arithmetic loads of the computer.

Figure 8:
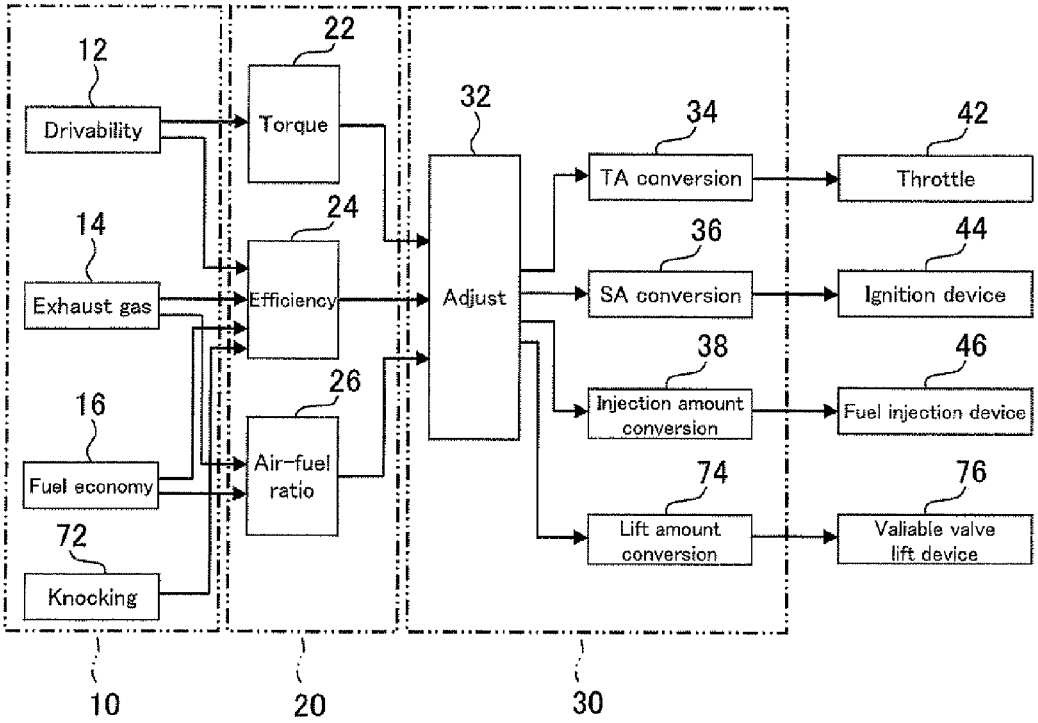
FIG. 8 is a block diagram illustrating another modification on the configuration of the engine control apparatus shown in FIG. 1.

Furthermore, according to the control apparatus of the present embodiment, it is easy to add actuators to be used for engine control. FIG. 8 is a block diagram showing a configuration in which a variable valve lift controller is added as a new actuator to make a maximum lift of the intake valves variable. As shown in FIG. 8, to add the new actuator (variable valve lift controller) 76, an appropriate control variable computing element 74 needs only to be additionally provided in the control variables setting level 30 and connected to the adjuster portion 32. In the control variable computing element 74, the amount of lift of the intake valves is computed using a signal output from the adjuster portion 32. Signal transmission from the adjuster portion 32 to each control variable computing element is unidirectional and no signals are transmitted between the control variable computing elements, so the addition of the new control variable computing element 74 does not change other element designs.

Second Embodiment

Figure 9:
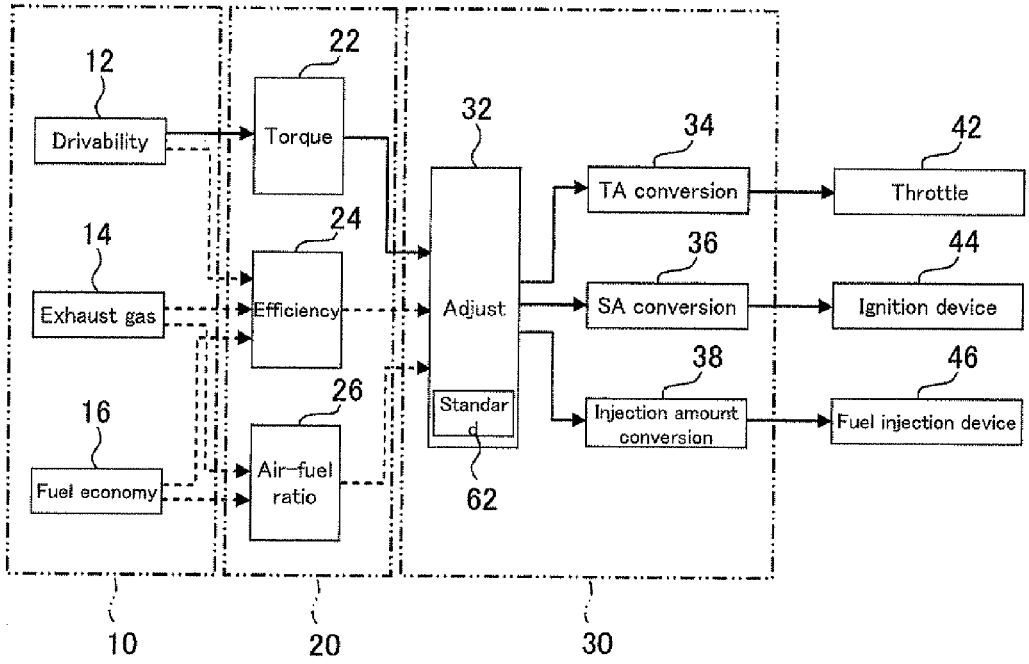
FIG. 9 is a block diagram illustrating the configuration of an engine control apparatus according to a second embodiment of the present invention.

Next, a second embodiment of the present invention is described below using the accompanying drawings. FIG. 9 is a block diagram showing a configuration of the engine control apparatus, the second embodiment of the invention. In FIG. 9, the same reference number is assigned to elements common to those of the first embodiment. In the following paragraphs, description of the elements common to those of the first embodiment is omitted or simplified and focus is placed mainly upon feature portions of the present embodiment.

The control apparatus of the present embodiment has features in the operation of the demand output elements 12, 14, and 16. The demand output elements 12, 14, and 16 are each constructed so that only if non-standard demands occur, will demand values be output for the items expressed in terms of efficiency or the air-fuel ratio. Additionally, a storage portion 62 in which standard values of the efficiency demand value and air-fuel ratio demand value are stored is provided in the control variables setting level 30, and more specifically, in the adjuster portion 32. These standard values are stored in the form of mappings in association with the operating parameters and operational states of the engine. The adjuster portion 32 is constructed so that if the efficiency demand value is not output from the efficiency mediation element 24 or if the air-fuel ratio demand value is not output from the air-fuel ratio mediation element 26, the adjuster portion 32 will alternatively use the corresponding standard values stored within the storage portion 62 to conduct computations.

Of the three major factors (torque, efficiency, and air-fuel ratio demand values) that determine the outputs of the engine, the torque demand value, in particular, is the mandatory demand in engine control and this demand is constantly changing. In contrast, the efficiency demand value and the air-fuel ratio demand value usually remain fixed and invariant, and both usually change, only when some situation arises. Only if the efficiency demand value and the air-fuel ratio demand value differ from the respective standard ones, therefore, will the respective demand values be output, and under the standard demands, data will be computed using the standard values. The arithmetic loads on the control apparatus, and more particularly, those of the demand generation level 10 and the mediation level 20 can thus be reduced. In this case, the standard values will be used alternatively when the control variables of the actuators 42, 44, and 46 are computed, so each of these actuators can be appropriately operated so that engine trouble does not occur during the operation of the engine.

Third Embodiment

Figure 10:
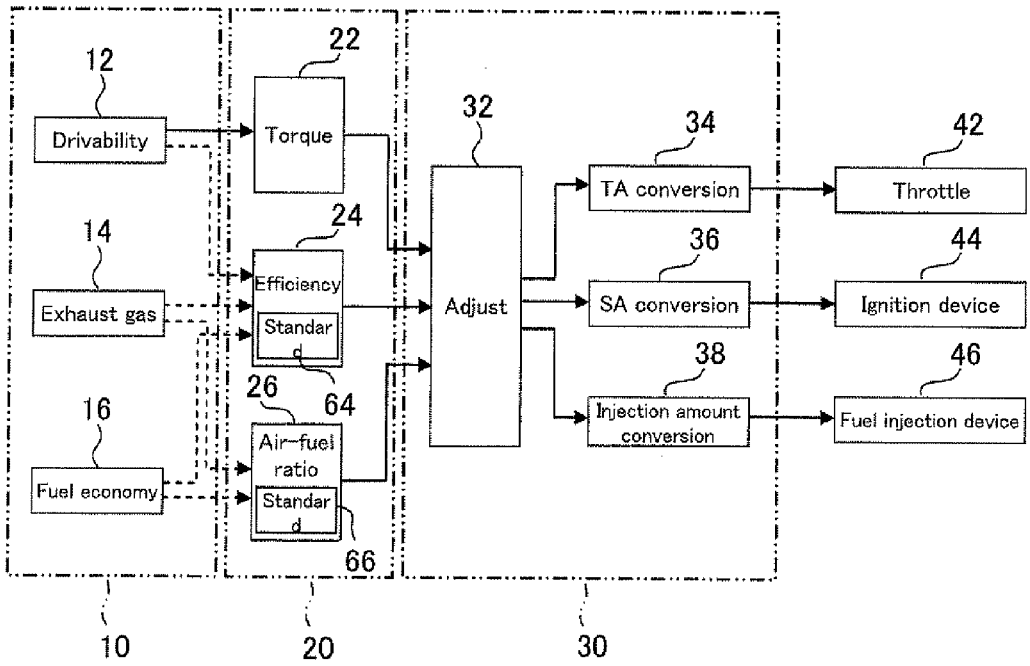
FIG. 10 is a block diagram illustrating the configuration of an engine control apparatus according to a third embodiment of the present invention.

Next, a third embodiment of the present invention is described below using the accompanying drawings. FIG. 10 is a block diagram showing a configuration of the engine control apparatus, the third embodiment of the invention. In FIG. 10, the same reference number is assigned to elements common to those of the first embodiment. In the following paragraphs, description of the elements common to those of the first embodiment is omitted or simplified and focus is placed mainly upon feature portions of the present embodiment.

The control apparatus of the present embodiment has features in configurations of the efficiency mediation element 24 and the air-fuel ratio mediation element 26. The efficiency mediation element 24 includes a storage portion 64 in which standard values are stored for each item corresponding to the demand values that are to be output from the demand output elements 12, 14, and 16. These standard values are stored in the form of mappings in association with the operating parameters and operational states of the engine. For items corresponding to the demand values that are not to be output from the demand output elements 12, 14, and 16, the efficiency mediation element 24 is adapted to mediate efficiency demand values using the stored standard values.

The air-fuel ratio mediation element 26 includes a storage portion 66 in which standard values are stored for each item corresponding to the demand values that are to be output from the demand output elements 14, and 16. These standard values are stored in the form of mappings in association with the operating parameters and operational states of the engine. For the items corresponding to the demand values that are not to be output from the demand output elements 14 and 16, the air-fuel ratio mediation element 26 is adapted to mediate air-fuel ratio demand values using the stored standard values.

The demand output elements 12, 14, and 16 are each constructed so that only if demands different from standard ones occur, will demand values be output for the items expressed in terms of efficiency or the air-fuel ratio. In this way, the demand values are output only in the event of non-standard demands occurring, and under the standard demands, the mediations in the mediation elements 24 and 26 are conducted using the standard values. This allows reduction of the arithmetic loads in the control apparatus, especially, the arithmetic load in the demand generation level 10. Additionally, since the efficiency demand value and the air-fuel ratio demand value are reliably output from the mediation elements 24 and 26, respectively, the actuators 42, 44, and 46 can be appropriately operated so that engine trouble does not occur during the operation of the engine.

Miscellaneous

The types of actuators to be controlled in the present invention are not limited to the throttle, ignition device, fuel injection device, or variable valve lift device. For example, a variable valve timing device (VVT) and an external EGR device can also be used as actuators that are to be controlled. In addition, in an engine equipped with a cylinder deactivation mechanism and with a compression ratio variable mechanism, these mechanisms can be used as actuators that are to be controlled. In an engine with a motor-assisted turbocharger (MAT), the MAT may be used as an actuator that is to be controlled. In addition, an alternator and other auxiliaries driven by the engine can be used as actuators since the engine outputs can likewise be controlled by applying these auxiliaries.

The present invention is not limited to the above-described embodiments and may be modified in various forms without departing from the spirit and scope of the invention. In the above-described embodiments, for example, the common signal delivery system is used to deliver the signals (common information) related to the operating parameters and operational states of the engine. Alternatively, these signals may be delivered, together with the demand values, from a higher hierarchical level to a lower one. Compared with using the common signal delivery system, using such an alternative method to transmit signals between the hierarchical levels will increase the volume of signals transmitted. However, since the signals will be transmitted in one direction only, significant increases in arithmetic load will be prevented.

The invention claimed is:

1. A control apparatus for an internal combustion engine, comprising:

a plurality of actuators related to operation of the internal combustion engine;

a demand output unit that outputs demands related to various performances that are required at one time for the internal combustion engine, each of the demands being expressed in one or more physical quantities selected for each of the performances from among three types of physical quantities, which are torque, efficiency of actually output torque to potentially outputable torque of the internal combustion engine and an air-fuel ratio, the demand output unit comprising one or more elements outputting demands expressed in one or more types of physical quantities including torque at least, one or more elements outputting demands expressed in one or more types of physical quantities including efficiency at least and one or more elements outputting demands expressed in one or more types of physical quantities including air-fuel ratio at least;

a torque mediation unit that collects, of a plurality of demand values output from the demand output unit, only demand values expressed in terms of torque, and then mediates the torque demand values into one in accordance with a predetermined rule;

an efficiency mediation unit that collects, of the plurality of demand values, only demand values expressed in terms of efficiency, and then mediates the efficiency demand values into one in accordance with a predetermined rule;

an air-fuel ratio mediation unit that collects, of the plurality of demand values, only demand values expressed in terms of an air-fuel ratio, and then mediates the air-fuel ratio demand values into one in accordance with a predetermined rule; and a control variable computing unit that computes control variables of each actuator, based upon the torque demand value, efficiency demand value, and air-fuel ratio demand value output from the respective mediation units.

2. The control apparatus for the internal combustion engine according to claim 1, wherein the various performances include performances related to drivability, performances related to exhaust gases, and performances related to fuel consumption.

3. The control apparatus for the internal combustion engine according to claim 1, wherein the plurality of actuators include an actuator that adjusts an intake air amount in the internal combustion engine, an actuator that adjusts ignition timing in the internal combustion engine, and an actuator that adjusts a fuel injection amount in the internal combustion engine.

4. The control apparatus for the internal combustion engine according to claim 1, the control apparatus further comprising:

a modification unit that modifies at least one of the torque demand value, efficiency demand value, and air-fuel ratio demand value output from the respective mediation units, and thereby ensures that a combustion condition determined by a relationship among the torque demand value, the efficiency demand value, and the air-fuel ratio demand value falls within a combustion limit.

5. The control apparatus for the internal combustion engine according to claim 4, wherein the modification unit modifies only either the efficiency demand value or the air-fuel ratio demand value without modifying the torque demand value.

6. The control apparatus for the internal combustion engine according to claim 1, wherein the control variable computing unit includes a storage portion in which are stored respective standard values of the efficiency demand value and the air-fuel ratio demand value; and the control variable computing unit is constructed such that if the efficiency demand value is not output from the efficiency mediation unit or if the air-fuel ratio demand value is not output from the air-fuel ratio mediation unit, the computing unit uses the stored standard values to compute the control variables of each actuator.

7. The control apparatus for the internal combustion engine according to claim 1, wherein the efficiency mediation unit includes a storage portion in which standard values are stored for items corresponding to the demand values that are to be output from the demand output unit to the efficiency mediation unit; and the efficiency mediation unit is constructed such that for an item corresponding to a demand value not to be output from the demand output unit to the efficiency mediation unit, the mediation unit uses the stored appropriate standard value to adjust the efficiency demand value.

8. The control apparatus for the internal combustion engine according to claim 1, wherein the air-fuel ratio mediation unit includes a storage portion in which standard values are stored for items corresponding to the demand values that are to be output from the demand output unit to the air-fuel ratio mediation unit; and the air-fuel ratio mediation unit is constructed such that for an item corresponding to a demand value not to be output from the demand output unit, the air-fuel ratio mediation unit uses the stored appropriate standard value to adjust the air-fuel ratio demand value.

9. The control apparatus for the internal combustion engine according to claim 6, wherein, of the demands related to the various performances, items expressed in terms of efficiency and items expressed in terms of the air-fuel ratio are each assigned a predetermined standard demand; and the demand output unit is constructed such that for items expressed in terms of efficiency or the air-fuel ratio, the output unit will output demand values only if demands different from respective standard demands exist.

* * * * *